United States Patent [19]

Mills

[11] Patent Number: 4,569,384

[45] **Date of Patent: *Feb. 11, 1986**

[54] DISSOLVING CERAMIC MATERIALS

[75] Inventor: David Mills, Bristol, England

[73] Assignee: Rolls-Royce Limited, England

[21] Appl. No.: 526,489

[22] Filed: Aug. 25, 1983

[*] Notice: The portion of the term of this patent subsequent to Feb. 25, 2003, has been disclaimed.

[30] Foreign Application Priority Data

Sep. 4, 1982 [GB] United Kingdom ..... 82225260

[51] Int. Cl.[4] ..... B22D 29/00

[52] U.S. Cl. ..... 164/131; 164/132

[58] Field of Search ..... 164/529, 132, 131, 122.1, 164/122.2, 519; 106/38.3, 38.9

[56] References Cited

U.S. PATENT DOCUMENTS

| | | | |
|---|---|---|---|
| 3,032,425 | 5/1962 | Leach | 106/38.3 |
| 3,968,828 | 7/1976 | Toeniskoetter et al. | 164/131 X |
| 4,026,344 | 5/1977 | Greskovich . | |
| 4,102,689 | 7/1978 | Borom . | |
| 4,134,771 | 1/1979 | Bentsen . | |
| 4,134,777 | 1/1979 | Borom . | |
| 4,141,781 | 2/1979 | Greskovich et al. . | |
| 4,184,885 | 1/1980 | Pasco et al. . | |
| 4,372,805 | 2/1983 | Takahashi et al. . | |

FOREIGN PATENT DOCUMENTS

| | | | |
|---|---|---|---|
| 23588 | 8/1979 | European Pat. Off. . | |
| 49-123031 | 11/1974 | Japan . | |
| 50-123031 | 9/1975 | Japan . | |
| 789335 | 1/1958 | United Kingdom . | |
| 926012 | of 1963 | United Kingdom . | |
| 1070382 | 6/1963 | United Kingdom | 106/38.9 |
| 1022278 | 3/1966 | United Kingdom . | |
| 1211824 | of 1970 | United Kingdom . | |
| 1419896 | of 1975 | United Kingdom . | |
| 2005169 | of 1979 | United Kingdom . | |
| 1548759 | 7/1979 | United Kingdom . | |
| 2042951 | 10/1980 | United Kingdom . | |
| 370281 | of 0000 | U.S.S.R. . | |

OTHER PUBLICATIONS

"Glossary of Chemical Terms" by Hampel and Hawley; publisher Van Nostrand Reinhold Company; pp. 57, 11 and 12.

"Non-Ferrous Foundry Metallurgy" by Murphy; publisher: Pergamon Press Ltd.; 1954; pp. 171, 175 & 194.

Translation Ref. No.: G8758, Federal Republic of Germany Public Disclosure Document DE 29 51 130 A1.

Translation Ref. No.: G8759, The Kolene-A1 Process, by R. Kuhn, Giesserei Praxis 23, 1965, 500-502.

Translation Ref. No.: G8760, Precision Casting Methods with Investment Casting Patterns, by H. Allendorf.

"Investment Casting by Centrax-Misco Limited", Tooling, Jul. 1965, No. 19-20, 22-26.

"Use of Silicones in Producing Moldable Precision Ceramics", G. T. Kookootsedes, T. E. Ruth, and P. G. Leonhard.

*Primary Examiner*—Nicholas P. Godici
*Assistant Examiner*—G. M. Reid
*Attorney, Agent, or Firm*—Parkhurst & Oliff

[57] ABSTRACT

Ceramic core materials are selectively dissolved from light metal, e.g. Aluminium or light alloy, e.g. Aluminium alloy castings which are themselves susceptible to attack by caustic alkali solutions, by providing the core material with a substance containing Hydrogen donor group which is capable of producing nascent hydrogen and contacting the core with fused anhydrous caustic alkalis. By this means Silica cores can be removed from Aluminium alloy castings, or a ceramic containing a hydrogen donor group can be selectively dissolved from one that does not, e.g. a Silica disposable pattern from within an Alumina mould containing an integral Alumina core.

26 Claims, No Drawings

DISSOLVING CERAMIC MATERIALS

The present invention relates to a method of dissolving ceramic materials, from components susceptible to attack by caustic alkali solutions. The invention has particular, but not exclusive, reference to a method of dissolving ceramic cores from castings made of light alloys or light metals or from moulds made in other ceramic materials. The invention also includes a process of casting including the above method.

The term "light alloy" is used in foundry technology as a generic term to define a class of casting alloys other than the Nickel and Cobalt-based superalloys, and includes alloys such as Aluminium alloys, Magnesium alloys, Titanium alloys, and Iron alloys including stainless steels. The term "light metal" has been added in this specification to include the base metals of such alloys, e.g. Aluminium, Magnesium, Titanium and Iron.

In casting of hollow gas turbine engine components in Nickel and Cobalt-based alloys, Silica cores are used to form the cavities within the components. The cores are removed by dissolution in caustic alkali solutions, e.g. sodium hydroxide or potassium hydroxide or mixtures thereof. The speed with which the core dissolves increases with the concentration of the caustic alkali in the solution and in the limit it has been known to use fused anhydrous caustic alkalis for high speed removal of Silica cores from components.

It is also well established in foundry practice that ceramic cores, e.g. Silica cores are not used with light metal or light alloy castings where the only method of removal is by dissolution, because the castings are attacked by the caustic alkali solutions normally used for removing the cores. Alternative acid baths have been devised for dissolving ceramic cores from certain of the light metal or light alloy castings, but these have not yet reached a stage of general acceptance because of the safety hazards involved, and the high cost of the acid soluble core materials used, e.g. Titania.

There is, therefore, presently a severe limitation on the production of small hollow components of complex internal geometry made in light metals or light alloys because of the lack of a suitable method of removing ceramic cores therefrom.

It is an object of the present invention to overcome this limitation and provide a method of removing ceramic cores from light alloy and light metal castings.

According to the present invention a method of dissolving a ceramic material from within a component made from a material susceptible to attack by caustic alkali solutions comprises including within the ceramic material a substance containing a Hydrogen donor group, and contacting the ceramic material with an anhydrous caustic alkali.

The term "Hydrogen donor group" is hereby defined as a chemical group which breaks down to release nascent Hydrogen, for example, a hydroxyl group, a hydride, or chemically combined water.

The substance containing the Hydrogen donor group must retain the group at the temperatures used in the manufacture and use of the ceramic material.

Also according to the present invention, there is provided a method of casting a hollow component in a light metal or light alloy material comprising the steps of:

making a mould, placing in the mould a ceramic core made from a material which includes a Hydrogen donor group, pouring molten component material into the mould and allowing it to solidify, removing the component from the mould and contacting the ceramic core with molten anhydrous caustic alkali to remove the core from the component.

Our research has shown that anhydrous caustic alkalis do not attack these light metals and light alloys although the caustic alkali solutions do.

We have also found that anhydrous caustic alkalis do not attack pure ceramics, i.e. those which have been fired at such high temperature that all of the water is driven off, e.g. high fired Alumina.

However, it is believed that the released Hydrogen from the Hydrogen donor group in the ceramic acts either as a catalyst or reacts with the Alumina and the alkali in some manner to produce a compound soluble in the alkali. This enables the ceramic containing the Hydrogen donor group to be selectively attacked by the anhydrous alkali in the presence of the light metal or light alloy which contains no Hydrogen donor group.

We have found that Silica cores contain such a Hydrogen donor group in the form of traces of water in various quantities depending on the method by which the Silica is made. Electrically fused Silica, which is the strongest type of Silica, contains the least amount of water, gas flame fused Silica contains more water and is easier to remove, and the type of Silica known as "satin" Silica, which is fused in air and drawn, contains more water and can readily be dissolved in an anhydrous caustic alkali bath.

Typical anhydrous caustic alkalis for use with the invention are Potassium Hydroxide, Sodium Hydroxide or Lithium Hydroxide or mixtures thereof. Other hydroxides of elements in the same group in the Periodic Table may, however, be used.

Examples of the invention will now be described in more detail.

EXAMPLE I

An Aluminium alloy test piece was cast around a pre-formed Silica core ⅛ in. diameter and 3 ins. long. By immersing the test piece in a 50/50 mixture by weight of fused anhydrous sodium and potassium hydroxides in a pure Nickel crucible at 400° C. the Silica core was removed in four hours without detriment to the Aluminium casting.

The Aluminium alloy had a composition of Copper 0.8–2%, Nickel 0.8–1.75%, Magnesium 0.05–0.2%, Iron 0.8–1.4%, Titanium 0.05–0.25%, Silicon 1.5–2.8%, by weight. The Silica core was solid and made by electrical fusion.

EXAMPLE II

A second Aluminium alloy test piece of the same composition was cast around a Silica core in the form of a hollow tube made in satin Silica. By immersing the test piece in a 50/50 mixture by weight of anhydrous sodium and potassium hydroxide in a pure Nickel crucible at 400° C. the Silica core was removed in twenty minutes without detriment to the Aluminium alloy.

EXAMPLE III

Several test pieces were made starting from Alumina powder which had been fired at a temperature above 1600° C. The powder was blended with approximately 2% to 3% by weight of Silica powder and formed into rods 2 mm×10 mm×100 mm in size by a standard process of mixing with a resin binder and injecting into a die. The rods were then fired at 1500° C. to make a high strength refractory article.

The rods were dipped into a liquid mixture consisting of 40% fused anhydrous Sodium Hydroxide and 60% fused anhydrous Potassium Hydroxide at approximately 200° C. and within 15 minutes up to 10 mm of the rods had been dissolved.

Similar lengths of pure, high fired Alumina rods were put into the same mixture of fused anhydrous caustic alkalis and no discernible dissolution had taken place after four hours.

The optimum amount of Silica to be added to the Alumina can be varied between ½% to 10% by weight but usually amounts at the lower end of the range, e.g. 2% to 3% are preferred since the presence of too much Silica with the Aluminium can cause formation of insoluble Aluminosilicates which will start to retard the dissolution process. A further advantage of a small Silica addition is that it will increase the strength of a low fired preformed Alumina core.

Clearly the mixture ratio of the alkalis can be varied from pure Sodium Hydroxide to pure Potassium Hydroxide to obtain the best results, and the temperature of the bath may also be varied to determine the optimum in each case.

An additional advantage of the Silica addition is that it will increase the strength of a pre-formed Alumina core.

The invention is not just applicable to the manufacture of metal castings. For example, in the field of printed circuits there is often a requirement to etch a circuit pattern onto a Silica base and the base is masked with Aluminium. The present invention will allow rapid etching of the Silica in the presence of Aluminium.

In a further application of the invention, in a process for making a thin-walled ceramic mould with an integral core, the core is surrounded by a disposable material and the ceramic mould shell invested around it. This process is described in our patent application No. 8219293 using a disposable of low melting point metal or an organic material. Such disposable materials will melt out on firing of the ceramics and the core will not be supported once this has happened. With the present invention, the core and mould can be made from ceramic materials not containing a Hydrogen donor group, e.g. pure Alumina, and the disposable can be a ceramic containing a Hydrogen donor group, e.g. Silica, so that the mould and core can be fired together with the Silica providing support for the core, and then the Silica can be selectively dissolved using a fused anhydrous caustic alkali mixture.

I claim:

1. A method of dissolving a ceramic material from a second component which is susceptible to attack by caustic alkali solutions, comprising the steps of:

forming a silica-based ceramic material to include a hydrogen donor group; and contacting said silica based ceramic material with an anhydrous caustic alkali to release said hydrogen donor group as nascent hydrogen.

2. The method of claim 1, wherein said second component which is susceptible to attack is selected from the group of materials consisting of light metals, light alloys and ceramics which do not contain hydrogen donor groups.

3. The method of claim 1, wherein said silica is manufactured by a process selected from the group of processes consisting of electrical fusion of silica, gas flame fusion of silica and fusion and drawing of silica in air.

4. The method of claim 1, wherein said silica-based ceramic material comprises a mixture of alumina and silica and said silica is added to said alumina in an amount of 0.5% to 10.0% by weight.

5. The method of claim 4, when said amount of silica added to alumina is 2.0% to 3.0% by weight.

6. The method of claim 4, wherein said alumina is pre-fired to a temperature of approximately 1600° C. prior to being mixed with said silica.

7. The method of claim 1, wherein said hydrogen donor group is selected from the group consisting of hydroxyls, hydrides and chemically combined water.

8. The method of claim 1, wherein said anhydrous caustic alkali is selected from the group consisting of potassium hydroxide, sodium hydroxide, lithium hydroxide and mixtures thereof.

9. The method of claim 8, wherein said anhydrous caustic alkali is heated to a temperature above its melting point.

10. The method of claim 9, wherein said anhydrous caustic alkali is heated to approximately 400° C.

11. The method of claim 10, wherein said anhydrous caustic alkali is heated in a nickel crucible.

12. A method of dissolving a ceramic material from a second component which is susceptible to attack by caustic alkali solutions, comprising the steps of:

forming a silica-based ceramic material to contain a hydrogen donor group selected from the group consisting of hydroxyls, hydrides and chemically combined water;

contacting said silica-based ceramic material with a heated anhydrous caustic alkali selected from the group consisting of potassium hydroxide, sodium hydroxide, lithium hydroxide and mixtures thereof, whereby said heated anhydrous caustic alkali chemically attacks said silica-based ceramic material and does not chemically attack said second component which is susceptible to attack by caustic alkali solution.

13. The method of claim 12, wherein said silica-based heated anhydrous caustic alkali is molten.

14. The method of claim 12, wherein said ceramic material is selected from the group of materials consisting of:

electrically fused silica, gas flame fused silica, silica which is fused and drawn in air and mixtures of silica and alumina, wherein said silica is added to the alumina in an amount of 0.5% to 10.0% by weight.

15. The method of claim 14, wherein said amount of silica added to alumina is 2.0% to 3.0% by weight.

16. The method of claim 12, wherein said component which is susceptible to attack is selected from the group consisting of light metals, light alloys, and ceramics which do not contain hydrogen donor groups.

17. A method of dissolving a ceramic material from a light metal or a light alloy casting which is susceptible to attack by caustic alkali solutions, comprising the steps of:

forming a silica-based ceramic material selected from the group of materials consisting of electrically fused silica, gas flame fused silica, silica which is fused and drawn in air and mixtures of silica and alumina, wherein said silica is added to the alumina in an amount of 0.5% to 10% by weight, such that said silica-based ceramic material contains a hydrogen donor group selected from the group consisting of hydroxyls, hydroxides and chemically combined water;

contacting said silica-based ceramic material with a heated anhydrous caustic alkali selected from the group consisting of potassium hydroxide, sodium hydroxide, lithium hydroxide and mixtures thereof, whereby said heated anhydrous caustic alkali chemically attacks said ceramic material and does not chemically attack said light metal or light alloy casting.

18. The method of claim 17, wherein said amount of silica added to alumina is 2.0% to 3.0% by weight.

19. The method of claim 17, wherein said heated anhydrous caustic alkali is molten.

20. A method of casting a hollow component made of a material susceptible to attack by caustic alkali solutions, comprising the steps of:

making a mold;

placing in the mold a core comprising a silica-based ceramic material containing a hydrogen donor group;

pouring a molten component susceptible to attack by caustic alkali solutions into the mold and around the core and allowing the molten component to solidify;

removing the solidified component from the mold; and contacting the ceramic core with a molten anhydrous caustic alkali to dissolve the core from the solidified component.

21. The method of claim 20, (wherein said ceramic material containing a hydrogen donor group is selected from the group of materials consisting of electrically fused silica, gas flame fused silica, silica which is fused and drawn in air and mixtures of silica and alumina), (wherein said silica is added to the alumina in an amount of 0.5% to 10.0% by weight.

22. The method of claim 21, wherein said amount of silica added to alumina is 2.0% to 3.0% by weight.

23. The method of claim 20, wherein said molten anhydrous caustic alkali is selected from the group consisting of potassium hydroxide, sodium hydroxide, lithium hydroxide and mixtures thereof.

24. The method of claim 20, wherein said hydrogen donor group is selected from the group consisting of hydroxyls, hydrides and chemically combined water.

25. A method of casting a hollow component made of a material susceptible to attack by caustic alkali solutions, comprising the steps of:

making a mold;

placing in the mold a core comprising a silica-based ceramic material selected from the group of materials consisting of electrically fused silica, gas flame fused silica, silica which is fused and drawn in air and mixtures of silica and alumina, wherein said silica is added to the alumina in an amount of 0.5% to 10.0% by weight, and said silica based ceramic material contains a hydrogen donor group selected from the group consisting of hydroxyls, hydrides and chemically combined water;

pouring a molten component susceptible to attack by caustic alkali solutions into the mold and around the core and allowing the molten component to solidify;

removing the solidified component from the mold; and contacting the ceramic core with a molten anhydrous caustic alkali selected from the group consisting of potassium hydroxide, sodium hydroxide, lithium hydroxide and mixtures thereof, to dissolve the core from the solidified component.

26. The method of claim 25, wherein said amount of silica added to alumina is 2.0% to 3.0% by weight.

* * * * *